US011112150B2

(12) United States Patent
Maeda et al.

(10) Patent No.: US 11,112,150 B2
(45) Date of Patent: Sep. 7, 2021

(54) HEAT EXCHANGER AND REFRIGERATION CYCLE DEVICE

(71) Applicant: Mitsubishi Electric Corporation, Tokyo (JP)

(72) Inventors: Tsuyoshi Maeda, Tokyo (JP); Shin Nakamura, Tokyo (JP); Akira Yatsuyanagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 25 days.

(21) Appl. No.: 16/484,245

(22) PCT Filed: May 11, 2017

(86) PCT No.: PCT/JP2017/017900
§ 371 (c)(1),
(2) Date: Aug. 7, 2019

(87) PCT Pub. No.: WO2018/207321
PCT Pub. Date: Nov. 15, 2018

(65) Prior Publication Data

US 2020/0326111 A1 Oct. 15, 2020

(51) Int. Cl.
*F25B 39/02* (2006.01)
*F25D 17/06* (2006.01)

(52) U.S. Cl.
CPC ..... *F25B 39/02* (2013.01); *F25D 17/067* (2013.01)

(58) Field of Classification Search
CPC ..... F25B 39/02; F25D 17/067; F25D 21/14; F24F 13/222; F24F 2013/227
See application file for complete search history.

(56) References Cited

U.S. PATENT DOCUMENTS

2013/0299142 A1* 11/2013 Yoshioka ..... F25B 39/00 165/151
2013/0299153 A1 11/2013 Jindou et al.
(Continued)

FOREIGN PATENT DOCUMENTS

CN 106370045 A 2/2017
JP 2005-201467 A 7/2005
(Continued)

OTHER PUBLICATIONS

Office Action dated Jul. 17, 2020 issued in corresponding CN patent application No. 201780090428.1 (and English translation).
(Continued)

*Primary Examiner* — Marc E Norman
(74) *Attorney, Agent, or Firm* — Posz Law Group, PLC

(57) ABSTRACT

A heat exchanger includes a fin having a first through hole into which a first heat transfer tube is inserted and a second through hole into which a second heat transfer tube is inserted and including a first end portion and a second end portion, in which a virtual straight line passing through end portions on the first end portion side of the first heat transfer tube and the second heat transfer tube is a first virtual straight line, a virtual straight line passing through end portions on the second end portion side of the first heat transfer tube and the second heat transfer tube is a second virtual straight line, a region between the first end portion and the first virtual straight line is a first drainage region, a region between the second end portion and the second virtual straight line is a second drainage region, and a region enclosed by the first heat transfer tube, the second heat transfer tube, the first virtual straight line and the second virtual straight line is a water introducing region, a first groove inclined to descend toward the first drainage region
(Continued)

and a second groove inclined to descend toward the second drainage region are formed in the water introducing region.

7 Claims, 10 Drawing Sheets

(56) References Cited

U.S. PATENT DOCUMENTS

| | | | | |
|---|---|---|---|---|
| 2015/0184909 | A1* | 7/2015 | Haseba | F28D 1/05366 62/129 |
| 2018/0372429 | A1* | 12/2018 | Maeda | F28F 17/005 |
| 2019/0049162 | A1* | 2/2019 | Akaiwa | F28D 1/05383 |
| 2019/0383567 | A1* | 12/2019 | Maeda | F28F 1/325 |
| 2020/0018494 | A1* | 1/2020 | Yatsuyanagi | F28F 13/06 |

FOREIGN PATENT DOCUMENTS

| | | | |
|---|---|---|---|
| JP | 2012-037154 | A | 2/2012 |
| JP | 2012-163317 | A | 8/2012 |
| JP | 2014-035122 | A | 2/2014 |

OTHER PUBLICATIONS

International Search Report of the International Searching Authority dated Jul. 18, 2017 for the corresponding international application No. PCT/JP2017/017900 (and English translation).

Office Action dated Feb. 9, 2021 issued in corresponding CN patent application No. 201780090428.1 (and English translation).

Decision of Rejection dated Jul. 13, 2021, issued in corresponding CN Patent Application No. 201780090428.1 (and English Machine Translation).

* cited by examiner

HEAT EXCHANGER AND REFRIGERATION CYCLE DEVICE

CROSS REFERENCE TO RELATED APPLICATION

This application is a U.S. national stage application of International Application No. PCT/JP2017/017900, filed on May 11, 2017, the contents of which are incorporated herein by reference.

TECHNICAL FIELD

The present invention relates to a fin tube-type heat exchanger and a refrigeration cycle device provided with this heat exchanger.

BACKGROUND

Fin tube-type heat exchangers have hitherto been known, which are provided with a plurality of planar fins arranged at predetermined fin pitch intervals and a plurality of heat transfer tubes juxtaposed in a vertical direction at predetermined intervals and penetrating the respective fins in a juxtaposition direction of the fins. As such a fin tube-type heat exchanger, one using flat tubes as the heat transfer tubes is proposed. The "flat tubes" refer to heat transfer tubes having, for example, an oblong cross-section that has a horizontal width larger than a vertical width in cross-section perpendicular to a flow direction of refrigerant. Hereinafter, a fin tube-type heat exchanger using a flat tube may often be referred to as a "flat tube heat exchanger."

In addition to the ability to secure a large heat transfer area in the pipe as compared to a heat exchanger using a cylindrical heat transfer tube, the flat tube heat exchanger can suppress ventilation resistance of a heat exchange fluid, and can thereby improve heat transfer performance. On the other hand, the flat tube heat exchanger tends to have inferior drainage performance compared to heat exchangers using a cylindrical heat transfer tube. This is because water tends to remain on a top surface of the flat tube. For this reason, when the flat tube heat exchanger is used as an evaporator, the following problems may arise.

When the fin tube-type heat exchanger is used as an evaporator, the air that is a heat exchange fluid is cooled by the heat exchanger and moisture in the air condenses on the heat exchanger. That is, water adheres to the surface of the fin and the heat transfer tube, and a water film is formed on the surface of the fin and the heat transfer tube. In the case of the flat tube heat exchanger having poor drainage performance, water adhering to the surface of the fin and the heat transfer tube tends to remain, and so the thickness of the water film formed on the surface of the fin and the heat transfer tube increases, and also the water film forms in a wider range. For this reason, when the flat tube heat exchanger is used as an evaporator, heat exchange between the fin and the heat transfer tube, and the air is blocked by the water film, and the heat transfer performance of the flat tube heat exchanger deteriorates. Moreover, when the flat tube heat exchanger is used as an evaporator, the water adhering to the surface of the fin and the heat transfer tube tends to remain, and so the ventilation resistance of air passing through the flat tube heat exchanger increases.

Furthermore, in the case of, for example, an air-conditioning device, which is an example of a refrigeration cycle device, an outdoor heat exchanger functions as an evaporator in a low outdoor air temperature environment during heating operation. For this reason, water adhering to the outdoor heat exchanger during heating operation freezes and frosts. For this reason, the air-conditioning device is generally provided with a defrosting operation mode to melt the frost adhering to the outdoor heat exchanger for the purpose of, for example, preventing an increase of ventilation resistance, deterioration of heat transfer performance, and damage occurring in the outdoor heat exchanger due to frost formation.

In this case, when the heating operation is resumed before water generated by defrosting is discharged from the outdoor heat exchanger, the water remaining in the outdoor heat exchanger freezes and grows into large frost. For this reason, it is necessary to set a defrosting operation time so that water does not remain as much as possible in the outdoor heat exchanger. In this case, when a flat tube heat exchanger in which water adhering to the surface of the fin and the heat transfer tube tends to remain is used as the outdoor heat exchanger, drainage from the flat tube heat exchanger takes time, and so it is necessary to extend the defrosting operation time. As a result, using the flat tube heat exchanger as an outdoor heat exchanger may lead to deterioration of comfortability and deterioration of an average heating capacity.

Therefore, a flat tube heat exchanger for improved drainage performance is also proposed for the existing fin-and-tube-type heat exchangers (e.g., see Patent Literature 1). The flat tube heat exchanger described in Patent Literature 1 is configured such that air is supplied by a fan in a horizontal direction. In the flat tube heat exchanger described in Patent Literature 1, a plurality of notches opened at an end on an upwind-side, which is one end in the horizontal direction, are formed at predetermined intervals in the vertical direction. In addition, a flat tube is inserted into each of the notches. At each fin of the flat tube heat exchanger described in Patent Literature 1, a drainage region without any notch opening port is formed between the end on a downwind-side, which is the other end in the horizontal direction and the flat tube. At each fin of the flat tube heat exchanger described in Patent Literature 1, a concavo-convex part, a ridge of which is inclined to descend from an upwind-side toward a downwind-side is formed in a region between adjacent flat tubes in the vertical direction. That is, the flat tube heat exchanger described in Patent Literature 1 aims at improving drainage performance by guiding water adhering to the fins to the drainage region through the concavo-convex part.

Patent Literature

Patent Literature 1: Japanese Unexamined Patent Application Publication No. 2012-163317

In the flat tube heat exchanger described in Patent Literature 1, water adhering to the region, which is an end portion on the upwind-side of the fin surface is carried by the concavo-convex part to the vicinity of the central part on the top surface of the flat tube disposed below the concavo-convex part. The water carried to the vicinity of the central part of the top surface of the flat tube is discharged downward along the end portion in the horizontal direction of the flat tube. That is, the vicinity of the central part of the top surface of the flat tube is distant from both ends in the horizontal direction of the flat tube, and is a region most difficult to drain. Therefore, the flat tube heat exchanger described in Patent Literature 1 still has room for improvement in drainage performance.

To solve the problem associated with the flat tube heat exchanger described in Patent Literature 1, the angle of inclination of the ridge of the concavo-convex part relative to the horizontal line may be reduced. In other words, to solve the problem with the flat tube heat exchanger described in Patent Literature 1, the angle of inclination of the ridge of the concavo-convex part relative to a line perpendicular to the arrangement direction of the flat tube may be reduced. This is because it is thereby possible to carry the water adhering to the region, which is an end portion on the upwind-side of the fin surface, to the vicinity of the end portion on the downwind-side of the top surface of the flat tube. However, when the angle of inclination of the ridge of the concavo-convex part relative to the line perpendicular to the arrangement direction of the flat tube is reduced in this way, condensation water may retain in the concavo-convex part without attaining sufficient effects of gravity or condensation water overflowing from the concavo-convex part after retaining may fall to the top surface of the flat tube and retain there.

In addition, the concavo-convex part formed on the fin surface suppresses development of a temperature boundary layer by disturbing a flow of air passing between the fins, and an effect of improving heat transfer performance of the fin-and-tube-type heat exchanger can be expected. However, as described above, when the angle of inclination of the ridge of the concavo-convex part relative to the line perpendicular to the arrangement direction of the flat tube is reduced, the effect of improving the heat transfer performance of the fin-and-tube-type heat exchanger is impaired. This is because the direction of the flow of air passing between the fins, that is, the direction of the flow of air supplied from a fan is a direction substantially perpendicular to the arrangement direction of the flat tube. For this reason, as described above, when the angle of inclination of the ridge of the concavo-convex part relative to the line perpendicular to the arrangement direction of the flat tube is reduced, it is not possible to sufficiently disturb the flow of air passing between the fins.

SUMMARY

The present invention has been attained in order to solve the above-described problem, and a first object of the present invention is to provide a heat exchanger that can improve drainage performance and also secure heat transfer performance. A second object of the present invention is to provide a refrigeration cycle device equipped with such a heat exchanger.

A heat exchanger of one embodiment of the present invention includes a fin having a first through hole and a second through hole disposed below the first through hole, and including a first end portion and a second end portion in a horizontal direction, a first heat transfer tube inserted into the first through hole, a cross-section of the first heat transfer tube parallel to the fin having a flat shape, and a second heat transfer tube inserted into the second through hole, a cross-section of the second heat transfer tube parallel to the fin having a flat shape, in which, when a virtual straight line passing through an end portion of the first heat transfer tube on a first end portion side and an end portion of the second heat transfer tube on the first end portion side is a first virtual straight line, a virtual straight line passing through an end portion of the first heat transfer tube on a second end portion side and an end portion of the second heat transfer tube on the second end portion side is a second virtual straight line, a region between the first end portion and the first virtual straight line on a surface of the fin is referred to as a first drainage region, a region between the second end portion and the second virtual straight line on the surface of the fin is a second drainage region, and a region on the surface of the fin enclosed by the first heat transfer tube, the second heat transfer tube, the first virtual straight line and the second virtual straight line is a water introducing region, a first groove inclined to descend toward the first drainage region and a second groove disposed closer to the second drainage region than the first groove and inclined to descend toward the second drainage region are formed in the water introducing region.

Furthermore, a refrigeration cycle device of another embodiment of the present invention includes a refrigerant circuit that connects a compressor, a condenser, an expansion device and an evaporator via a refrigerant pipe and uses the heat exchanger of the one embodiment of the present invention as the evaporator.

The heat exchanger of the one embodiment of the present invention is configured to insert the heat transfer tube, which is a flat tube, into the through hole formed in the fin and attach the heat transfer tube to the fin. Therefore, drainage regions can be formed on both sides of the heat transfer tube on the fin surface of the heat exchanger of the one embodiment of the present invention. That is, the first drainage region is formed closer to the first end portion side than the heat transfer tube and the second drainage region is formed closer to the second end portion side than the heat transfer tube on the fin surface. With the heat exchanger of the one embodiment of the present invention, water adhering to the water introducing region can be led to the first drainage region side through the first groove and to the second drainage region side through the second groove. Therefore, the heat exchanger of the one embodiment of the present invention can improve the drainage performance.

With the first groove and the second groove formed on the fin surface, at least one of the concave part and the convex part is formed on the fin surface. Thus, it is possible to obtain an effect of suppressing development of a temperature boundary layer by disturbing the flow of air passing between the fins and improving heat transfer performance of the heat exchanger unless the angles of the concave part and the convex part relative to the line perpendicular to the arrangement direction of the heat transfer tube are reduced. Here, as compared to the case where the inclination of the concavo-convex part is reduced to improve the drainage performance in the flat tube heat exchanger described in Patent Literature 1, the heat exchanger of the one embodiment of the present invention can improve the drainage performance even when the angles of the first groove and the second groove relative to the line perpendicular to the arrangement direction of the heat transfer tube are increased. This is because water adhering to the water introducing region can be led to the first drainage region through the first groove and to the second drainage region through the second groove. In other words, with the heat exchanger of the one embodiment of the present invention, the angles of the concave part and the convex part formed on the fin surface are the same as the angles of the first groove and the second groove relative to the line perpendicular to the arrangement direction of the heat transfer tube. Thus, compared to the case where the inclination of the concavo-convex part is reduced to improve the drainage performance in the flat tube heat exchanger described in Patent Literature 1, the heat exchanger of the one embodiment of the present invention can increase the angles of the concave part and the convex part formed on the fin surface. Therefore, the heat exchanger of the one embodiment of the present invention can also secure the heat transfer performance.

DETAILED DESCRIPTION

Figure 1:
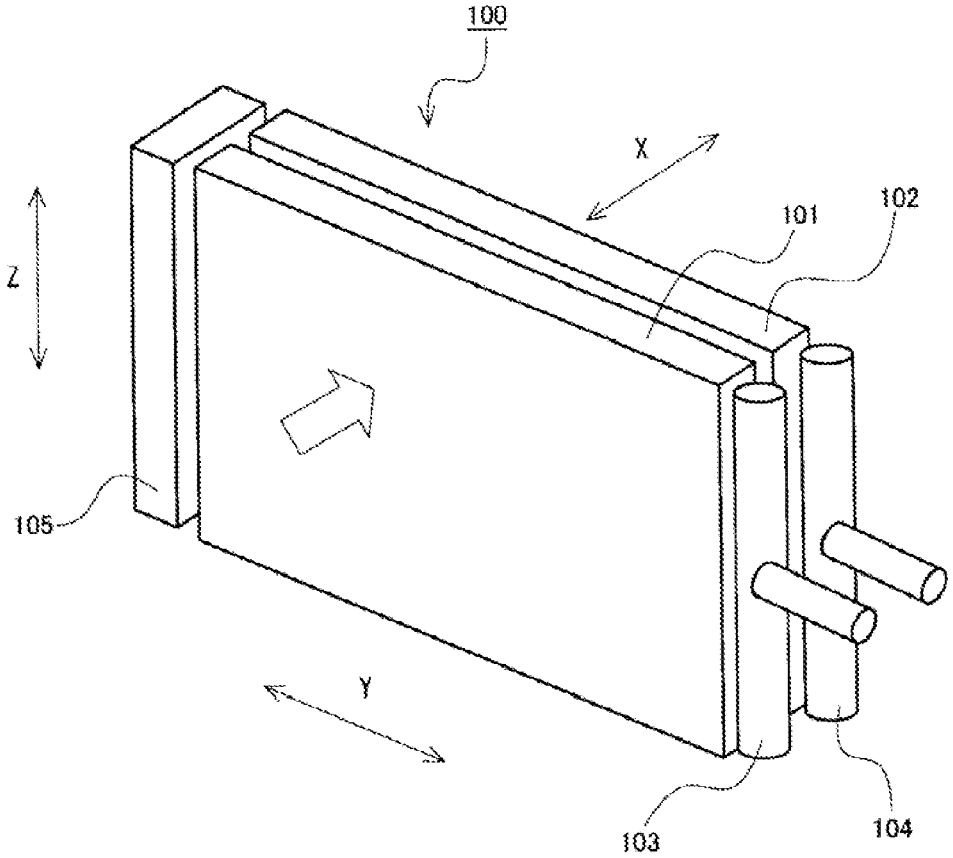
FIG. 1 is a perspective view illustrating an example of a heat exchanger of Embodiment 1 of the present invention.

Hereinafter, embodiments of the present invention will be described with reference to the accompanying drawings. Note that in the following drawings including FIG. 1, size relationships among components may be different from the actual relationships. In the following drawings including FIG. 1, components assigned identical reference numerals are identical or equivalent components, which will commonly apply to the entire text of the specification. Modes of components expressed in the entire text of the specification are merely examples and are not restrictive.

Embodiment 1

FIG. 1 is a perspective view illustrating an example of a heat exchanger of Embodiment 1 of the present invention. Note that a white arrow shown in FIG. 1 indicates a flow direction of air supplied from a fan to a heat exchanger 100.

The heat exchanger 100 according to present Embodiment 1 is a fin-and-tube-type heat exchanger having fins 10 and heat transfer tubes 30. In FIG. 1 and subsequent drawings, a direction, which is a horizontal direction or a traverse direction (width direction) of the fin 10, is referred to as an "X-direction." On the other hand, a direction, which is a horizontal direction or a juxtaposition direction of the fin 10 forming the same heat exchange part (an upwind-side heat exchanger 101 or a downwind-side heat exchanger 102, which will be described later), is referred to as a "Y-direction." A direction, which is a vertical direction (direction of gravity) or a longitudinal direction of the fin 10, is referred to as a "Z-direction." That is, air is supplied to the heat exchanger 100 according to present Embodiment 1 from the fan in the X-direction.

The heat exchanger 100 is, for example, a heat exchanger having a two-column structure and is provided with the upwind-side heat exchanger 101 and the downwind-side heat exchanger 102. The upwind-side heat exchanger 101 and the downwind-side heat exchanger 102 are fin-and-tube-type heat exchangers, and juxtaposed in the X-direction, which is a flow direction of air supplied from the fan. One end of a heat transfer tube of the upwind-side heat exchanger 101 is connected to an upwind-side header collection pipe 103. One end of a heat transfer tube of the downwind-side heat exchanger 102 is connected to a downwind-side header collection pipe 104. The other end of the heat transfer tube of the upwind-side heat exchanger 101 and the other end of the heat transfer tube of the downwind-side heat exchanger 102 are connected to an inter-column connection element 105.

That is, in the heat exchanger 100 according to present Embodiment 1, refrigerant is distributed from one of the upwind-side header collection pipe 103 and the downwind-side header collection pipe 104 to one heat transfer tube of the upwind-side heat exchanger 101 or the downwind-side heat exchanger 102. The refrigerant distributed to the one heat transfer tube of the upwind-side heat exchanger 101 or the downwind-side heat exchanger 102 flows into the other heat transfer tube of the upwind-side heat exchanger 101 or the downwind-side heat exchanger 102 via the inter-column connection element 105. After that, the refrigerant flowing into the other heat transfer tube of the upwind-side heat exchanger 101 or the downwind-side heat exchanger 102 joins at the other of the upwind-side header collection pipe 103 and the downwind-side header collection pipe 104 and flows to the outside of the heat exchanger 100.

Note that, according to present Embodiment 1, the upwind-side heat exchanger 101 and the downwind-side heat exchanger 102 have the same configuration. For this reason, the upwind-side heat exchanger 101 will be described below as a representative of both heat exchangers. Note that, when one of the upwind-side heat exchanger 101 and the downwind-side heat exchanger 102 can cover a heat exchange load of the heat exchanger 100, the heat exchanger 100 may, of course, be made up of only one of the upwind-side heat exchanger 101 and the downwind-side heat exchanger 102.

Figure 2:
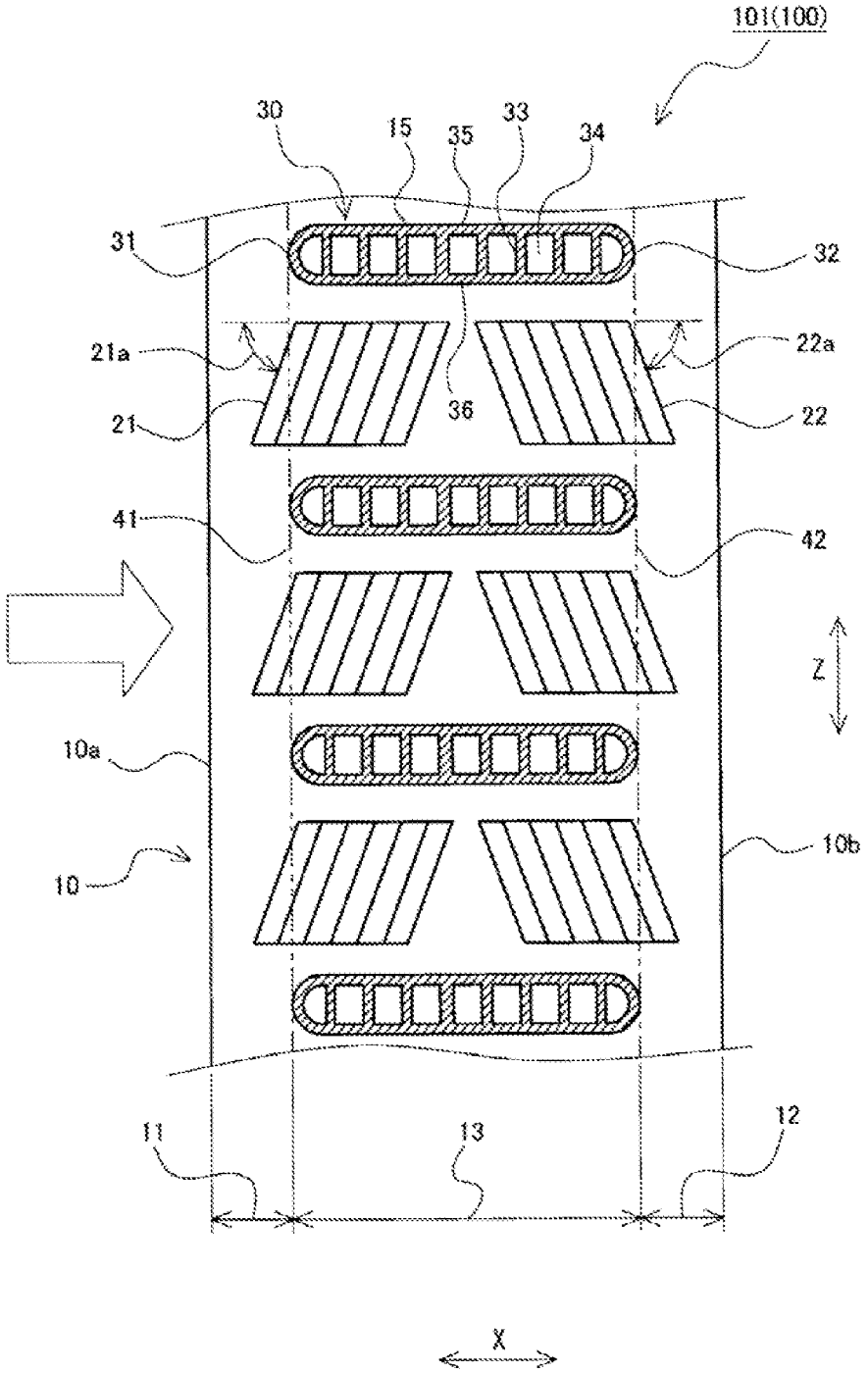
FIG. 2 is a longitudinal cross-sectional view illustrating essential parts of the heat exchanger of Embodiment 1 of the present invention.
Figure 3:
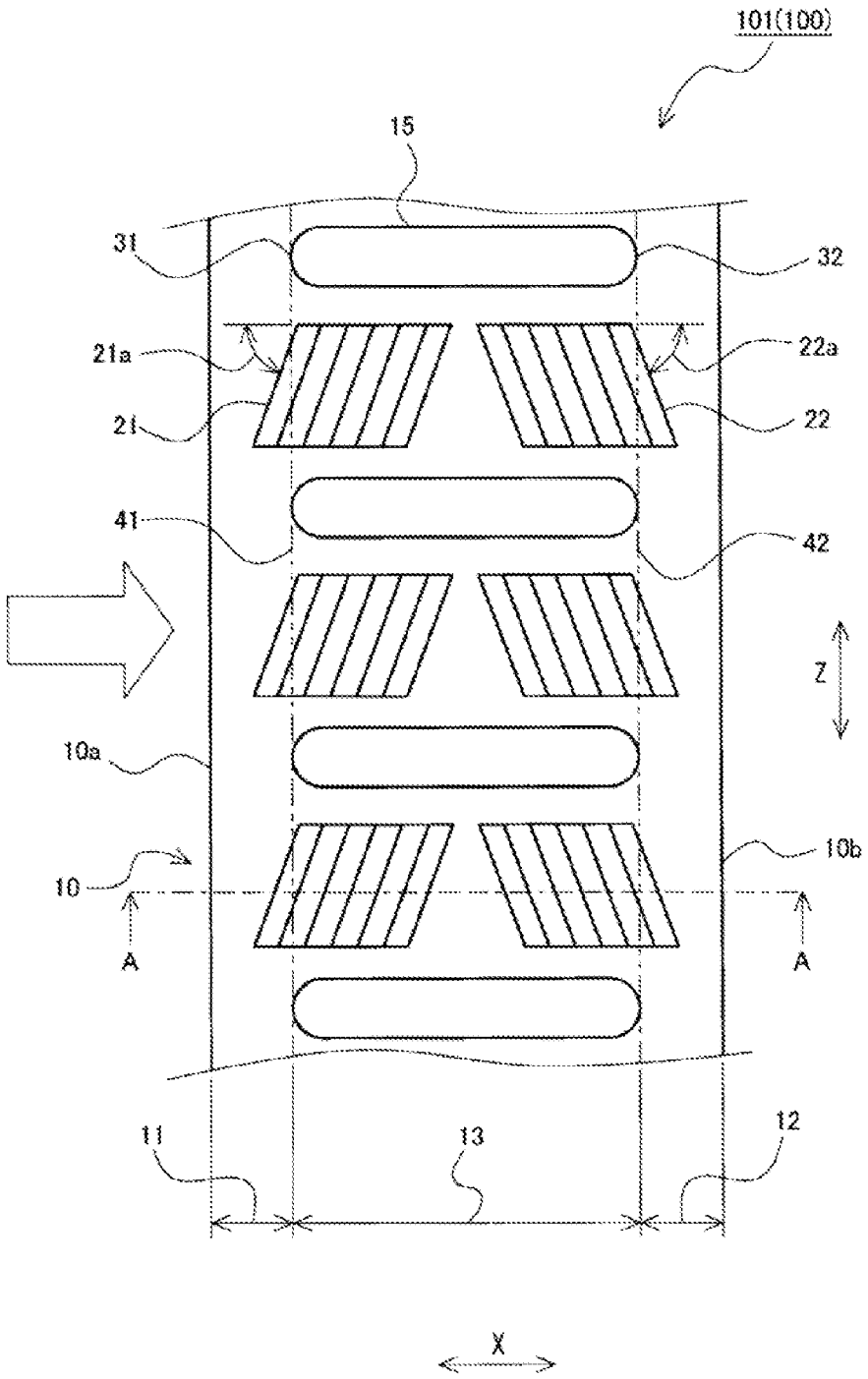
FIG. 3 is a diagram illustrating a fin part of the heat exchanger in FIG. 2.
Figure 4:
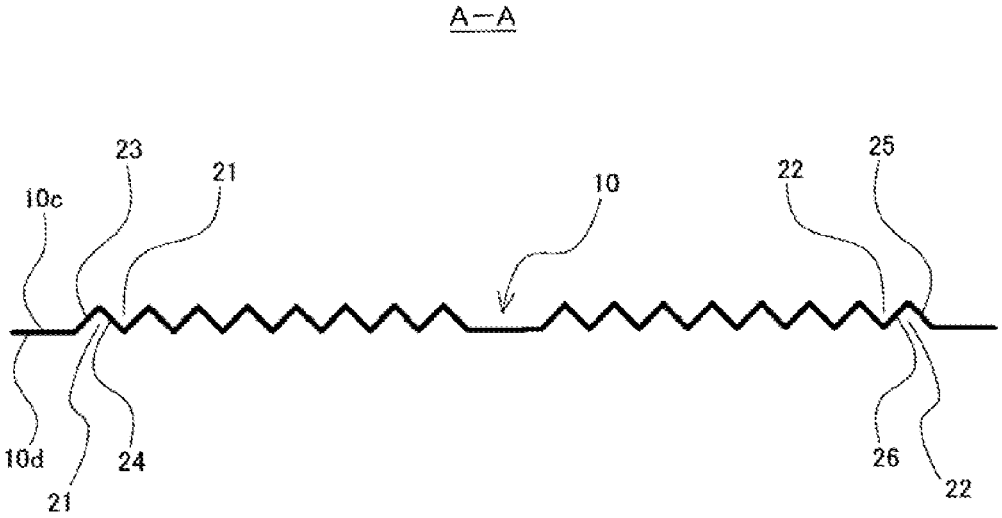
FIG. 4 is an A-A cross-sectional view of FIG. 3.
Figure 5:
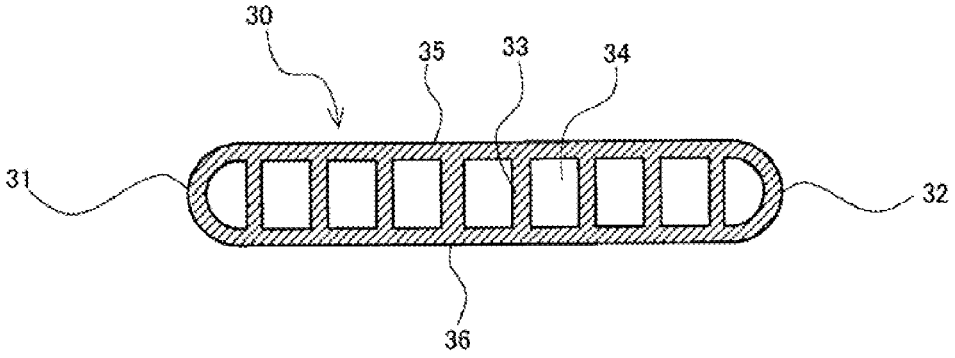
FIG. 5 is a diagram illustrating a heat transfer tube part of the heat exchanger in FIG. 2.

FIG. 2 is a longitudinal cross-sectional view illustrating essential parts of the heat exchanger of Embodiment 1 of the present invention. FIG. 3 is a diagram illustrating a fin part of the heat exchanger in FIG. 2. FIG. 4 is an A-A cross-sectional view of FIG. 3. FIG. 5 is a diagram illustrating a heat transfer tube part of the heat exchanger in FIG. 2. Note that FIG. 2 is a longitudinal cross-sectional view obtained by cutting the upwind-side heat exchanger 101 of the heat exchanger 100 in the X-direction.

The upwind-side heat exchanger 101 is provided with a plurality of fins 10 and a plurality of heat transfer tubes 30. The plurality of fins 10 are plate-like elements made of, for example, aluminum or aluminum alloy, and provided in a shape long in the vertical direction. The plurality of fins 10 are formed, for example, in a rectangular shape long in the vertical direction. The plurality of fins 10 are juxtaposed in the Y-direction at predetermined fin pitch intervals FP. Here, the plurality of fins 10 each have a first end portion 10*a* and a second end portion 10*b* in the horizontal direction. Air is supplied to the plurality of fins 10 by the fan from, for example, the first end portion 10*a* side. The air supplied by the fan passes between the neighboring fins 10 and flows out from the second end portion 10*b* side. That is, in present Embodiment 1, the first end portion 10*a* is an upwind-side end portion and the second end portion 10*b* is a downwind-side end portion.

A plurality of through holes 15 having a shape corresponding to an outer peripheral shape of the heat transfer tube 30 are formed at predetermined intervals in the vertical direction. The heat transfer tube 30 is inserted into each of the through holes 15. That is, the plurality of heat transfer tubes 30 are arranged at predetermined intervals in the vertical direction. The fins 10 and the heat transfer tubes 30 inserted into the through holes 15 are disposed in close contact with each other by, for example, brazing. Here, the arrangement direction of each heat transfer tube 30 is a direction substantially perpendicular to the flow direction of air supplied from the fan. As described above, in present Embodiment 1, the flow direction of the air supplied from the fan is the X-direction. For this reason, in present Embodiment 1, the heat transfer tubes 30 are arranged in the Z-direction. Note that when the flow direction of the air supplied from the fan is inclined relative to the X-direction, the arrangement direction of each heat transfer tube 30 is also inclined relative to the Z-direction. In other words, when the flow direction of the air supplied from the fan is inclined relative to the X-direction, the upwind-side heat exchanger 101 is inclined from the state in FIG. 2 in accordance with the inclination of the flow direction of the air supplied from the fan.

Here, of the through holes 15 adjacent in the vertical direction, the through hole 15 disposed above corresponds to a first through hole of the present invention. Of the through holes 15 adjacent in the vertical direction, the through hole 15 disposed below corresponds to a second through hole of the present invention. The heat transfer tube 30 inserted into the first through hole of the present invention corresponds to a first heat transfer tube of the present invention. The heat transfer tube 30 inserted into the second through hole of the present invention corresponds to a second heat transfer tube of the present invention.

The plurality of heat transfer tubes 30 are made of, for example, aluminum or aluminum alloy. As described above, the plurality of heat transfer tubes 30 are inserted into the through holes 15 of the fins 10. That is, the plurality of heat transfer tubes 30 penetrate the plurality of fins 10 in the juxtaposition direction (Y-direction) of the fins 10. The plurality of heat transfer tubes 30 are flat tubes, each of which has, for example, a substantially elongated round shape in cross-section parallel to the fins 10. In other words, the heat transfer tube 30 is shaped such that a cross-section in the major axis direction is larger than that in the minor axis direction. In present Embodiment 1, the plurality of heat transfer tubes 30 are arranged such that the major axis of each heat transfer tubes 30 in cross-section is oriented in the horizontal direction (X-direction). In other words, the plurality of heat transfer tubes 30 are arranged such that the major axis of each heat transfer tubes 30 in cross-section is oriented in the flow direction of the air supplied from the fan. Note that the cross-section of each heat transfer tube 30 is not limited to the substantially elongated round shape, but can have various shapes such as substantially ellipsoidal shape and substantially wedge shape. In the following description, the major axis direction of the heat transfer tube 30 in cross-section may be referred to as a "width direction" of the heat transfer tube 30.

Insides of the plurality of heat transfer tubes 30 serve as channels through which the refrigerant flows. The inside of each heat transfer tube 30 is partitioned by a plurality of barriers 33 in present Embodiment 1. In this way, a plurality of channels 34 through which the refrigerant flows are formed in the plurality of heat transfer tubes 30. This makes it possible to increase the contact area between the heat transfer tube 30 and the refrigerant, and improve heat exchange efficiency of the heat exchanger 100. Note that grooves or slits may also be formed on the surface of the barrier 33 and the inner wall surface of the heat transfer tube 30. This makes it possible to further increase the contact area between the heat transfer tube 30 and the refrigerant, and further improve the heat exchange efficiency of the heat exchanger 100.

Some existing heat exchangers having a flat tube as the heat transfer tube have a configuration in which notches open to one end in the horizontal direction of fins are formed in the fins and the heat transfer tube is inserted into the notches. On the other hand, in the heat exchanger 100 according to present Embodiment 1, the heat transfer tube 30 is inserted into the through hole 15 formed in the fin 10. In other words, the heat transfer tube 30 is inserted into the through hole 15, which is not open to the first end portion 10*a* and the second end portion 10*b* of the fin 10. For this reason, drainage regions without any notch for attaching the heat transfer tube to the fins can be formed in the vicinity of the first end portion 10*a* and the second end portion 10*b* for the fins 10 of the heat exchanger 100 according to present Embodiment 1.

More specifically, an end portion of the heat transfer tube 30 on the first end portion 10*a* side of the fin 10 is referred to as an "end portion 31." An end portion of the heat transfer tube 30 on the second end portion 10*b* side of the fin 10 is referred to as an "end portion 32." Furthermore, a virtual straight line passing through the end portion 31 of each heat transfer tube 30 is referred to as a "first virtual straight line 41." A virtual straight line passing through the end portion 32 of each heat transfer tube 30 is referred to as a "second virtual straight line 42." When such definitions are adopted, a first drainage region 11 is formed between the first end portion 10*a* and the first virtual straight line 41 on the surface of the fin 10. Furthermore, a second drainage region 12 is formed between the second end portion 10*b* and the second virtual straight line 42 on the surface of the fin 10.

As described above, no notch for attaching the heat transfer tube to the fin is formed in the first drainage region 11 and the second drainage region 12. For this reason, the water adhering to the first drainage region 11 and the second drainage region 12 is not pulled into the notch by surface tension as it slides down these areas by the action of gravity. Therefore, the water adhering to the first drainage region 11 and the second drainage region 12 is rapidly discharged from the lower end of the fin 10 to the outside of the heat exchanger 100.

Furthermore, to guide the water adhering to the surface of the fin 10 and the surface of the heat transfer tube 30 to the first drainage region 11 and the second drainage region, for example, a plurality of first grooves 21 and a plurality of second grooves 22 are formed on the surface of the fin according to present Embodiment 1. More specifically, a region of the surface of the fin enclosed by the heat transfer tubes 30 adjacent in the vertical direction, the first virtual straight line 41 and the second virtual straight line 42 is referred to as a water introducing region 13. The first groove 21 and the second groove 22 are formed in the water introducing region 13.

More specifically, the first groove 21 is formed closer to the first drainage region 11 than the second groove 22 in the water introducing region 13. This first groove 21 is inclined to descend toward the first drainage region 11. Note that the first groove 21 does not have to be formed to fit within the water introducing region 13 and the bottom end portion may be disposed in the first drainage region 11. The first groove 21 makes it easier to guide water to the first drainage region 11. Also, in present Embodiment 1, the first groove 21 is inclined by a first angle of inclination 21*a* relative to the X-direction, which is a flow direction of air supplied from the fan, on the surface of fin 10. That is, the first groove 21 is inclined by the first angle of inclination 21*a* relative to a line perpendicular to the arrangement direction of the heat transfer tube 30. Note that, the first angle of inclination 21*a* is an acute angle of angles formed between the line perpendicular to the arrangement direction of the heat transfer tube 30 and the first groove 21 on the surface of the fin 10.

Furthermore, the second groove 22 is formed closer to the second drainage region 12 than the first groove 21 in the water introducing region 13. This second groove 22 is inclined to descend toward the second drainage region 12. Note that the second groove 22 does not have to be formed to fit within the water introducing region 13, and the bottom end portion may be disposed in the second drainage region 12. The second groove 22 makes it easier to guide water to the second drainage region 12. In present Embodiment 1, the second groove 22 is inclined by a second angle of inclination 22*a* relative to the X-direction, which is the flow direction of the air supplied from the fan, on the surface of the fin 10. That is, the second groove 22 is inclined by the second angle of inclination 22*a* relative to a line perpendicular to the arrangement direction of the heat transfer tube 30. Note that the second angle of inclination 22*a* is an acute angle of angles formed between the line perpendicular to the arrangement direction of the heat transfer tube 30 and the second groove 22 on the surface of the fin 10. In present Embodiment 1, the second angle of inclination 22*a* is substantially the same angle as the first angle of inclination 21*a*.

Such first groove 21 and second groove 22 can be formed by making one of a convex part and a concave part on the surface of the fin 10 by, for example, pressing.

For example, as shown in FIG. 4, a plurality of convex parts 23, a ridge of which descends toward the first drainage region 11, are formed on a surface 10*c* side of the fin 10. Thus, a groove recessed than surroundings is formed between the adjacent convex parts 23. This groove can be referred to as the first groove 21. On the other hand, focusing on a surface 10*d* of the fin 10, which is the surface opposite to the surface 10*c*, the convex part 23 formed on the surface 10*c* side forms a concave part 24, a base portion of which extends to descend toward the first drainage region 11, when viewed from the surface 10*d* side. This concave part 24 can be made the first groove 21.

Similarly, as shown, for example, in FIG. 4, a plurality of convex parts 25, a ridge of which descends toward the second drainage region 12 are formed on the surface 10*c* side of the fin 10. Thus, a groove recessed from surroundings is formed between the adjacent convex parts 25. This groove can be referred to as the second groove 22. On the other hand, focusing on the surface 10*d* of the fin 10, which is the surface opposite to the surface 10*c*, the convex part 25 formed on the surface 10*c* side forms a concave part 26, a base portion of which extends to descend toward the second drainage region 12, when viewed from the surface 10*d* side. The concave part 26 can be made the second groove 22.

Next, a drainage process of the heat exchanger 100 configured as described above will be described.

When the heat exchanger 100 is used as an evaporator, the air supplied from the fan is cooled by the heat exchanger 100 and moisture in the air condenses on the heat exchanger 100. That is, water adheres to the surfaces of the fin 10 and the heat transfer tube 30. In this case, the water adhering to the surfaces of the fin 10 and the heat transfer tube 30 is discharged from the heat exchanger 100 as will be described below. When the air supplied from the fan has a low temperature, the water adhering to the surfaces of the fin 10 and the heat transfer tube 30 freezes and becomes frost. In such a case, defrosting operation is performed to melt the frost adhering to the fin 10 and the heat transfer tube 30. The water generated by melting the frost is also discharged from the heat exchanger 100 as will be illustrated below.

The water adhering to the first drainage region 11 and the second drainage region 12 of the surface of the fin 10 slides down these regions by the action of gravity. As described above, the first drainage region 11 and the second drainage region 12 do not have any notch for attaching the heat transfer tube to the fin. For this reason, the water adhering to the first drainage region 11 and the second drainage region 12 is rapidly discharged from the bottom end of the fin 10 to the outside of the heat exchanger 100. On the other hand, the water adhering to the water introducing region 13 of the surface of the fin 10 slides down along the first groove 21 or the second groove 22.

More specifically, the water sliding down along the first groove 21 is led to the first drainage region 11. Therefore, part of the water sliding down along the first groove 21 flows out to the first drainage region 11, and is rapidly discharged to the outside of the heat exchanger 100 from the bottom end of the fin 10. Also, part of the remaining water sliding down along the first groove 21 reaches a top surface 35 of the heat transfer tube 30 in the vicinity of the end portion 31. That is, part of the remaining water sliding down along the first groove 21 reaches a position in the vicinity of the first drainage region 11 of the top surface 35 of the heat transfer tube 30.

Similarly, water sliding downward along the second groove 22 is led to the second drainage region 12. Therefore, part of the water sliding downward along the second groove 22 flows out to the second drainage region 12 and is rapidly discharged from the bottom end of the fin 10 to the outside of the heat exchanger 100. Also, part of the remaining water that slides downward along the second groove 22 reaches the top surface 35 of the heat transfer tube 30 in the vicinity of the end portion 32. That is, part of the remaining water that slides downward along the second groove 22 reaches the position in the vicinity of the second drainage region 12 of the top surface 35 of the heat transfer tube 30.

That is, with the heat exchanger 100 according to present Embodiment 1, water retains on the top surface 35 of the heat transfer tube 30 in the vicinity of the end portion 31 and in the vicinity of the end portion 32.

Water retaining in the vicinity of the end portion 31 on the top surface 35 of the heat transfer tube 30 merges with the water that slides down along the first groove 21 and grows. When the water retaining in the vicinity of the end portion 31 on the top surface 35 of the heat transfer tube 30 reaches a certain volume or greater, it is led by the water flowing out from the first groove 21 to the first drainage region 11 and flows to the end portion 31. Part of the water flowing to the end portion 31 flows to the first drainage region 11, and is rapidly discharged from the bottom end of the fin 10 to the outside of the heat exchanger 100. Part of the remaining water flowing to the end portion 31 moves to an undersurface 36 of the heat transfer tube 30 along the end portion 31.

The water retaining in the vicinity of the end portion 32 on the top surface 35 of the heat transfer tube 30 joins the water sliding down along the second groove 22 and grows.

When the water retaining in the vicinity of the end portion 32 on the top surface 35 of the heat transfer tube 30 grows into a certain volume or greater, the water is led by the water flowing out from the second groove 22 to the second drainage region 12 and flows to the end portion 32. Part of the water flowing to the end portion 32 flows out to the second drainage region 12 and is rapidly discharged from the bottom end of the fin 10 to the outside of the heat exchanger 100. Part of the remaining water flowing to the end portion 32 moves to the undersurface 36 of the heat transfer tube 30 along the end portion 32.

The water wrapping around the undersurface 36 of the heat transfer tube 30 retains on the undersurface 36 of the heat transfer tube 30 and grows in a state where surface tension, gravity and stationary frictional force are balanced. This water swells in a downward direction as it grows, and the influence of gravity increases. When the gravity acting on water excels the force acting upward in the direction of gravity such as surface tension, water no longer receives the influence of surface tension, detaches from the undersurface 36 of the heat transfer tube 30 and drops onto the water introducing region 13 below. The water dropping into the water introducing region 13 falls along the first groove 21 and the second groove 22 as described above, repeats the aforementioned action and is finally discharged from below the heat exchanger 100.

That is, the heat exchanger 100 according to present Embodiment 1 can discharge the water adhering to the heat exchanger 100 while suppressing water retaining in the vicinity of the central part in the width direction on the top surface 35 of the heat transfer tube 30. The vicinity of the central part in the width direction on the top surface 35 of the heat transfer tube 30 is a position far from the end portions 31 and 32 of the heat transfer tube 30 and is a region where drainage is most difficult. The heat exchanger 100 according to present Embodiment 1 can drain while preventing water from retaining in the region most difficult to drain and can thereby improve drainage performance.

In the fin-and-tube-type heat exchanger, concavo-convex parts are formed on the fin surface to disturb the flow of air passing between the fins, suppress development of a temperature boundary layer, and it is thereby possible to obtain an effect of improving heat transfer performance of the fin-and-tube-type heat exchanger. In the heat exchanger 100 according to present Embodiment 1, when the first angle of inclination 21*a* of the first groove 21 or the second angle of inclination 22*a* of the second groove 22 is reduced, heat transfer performance of the heat exchanger 100 can be improved. In other words, unless the angles of inclination of the convex part 23 and the concave part 24 that form the first groove 21 are reduced or the angles of inclination of the convex part 25 and the concave part 26 that form the second groove 22 are reduced, it is possible to improve heat transfer performance of the heat exchanger 100.

For example, it is assumed that, in the heat exchanger 100 according to present Embodiment 1, only the first groove 21 is formed in the water introducing region 13 of the fin 10 and the second groove 22 is not formed. In this case, to improve drainage performance of the heat exchanger 100, water dropping into the water introducing region 13 from the vicinity of the end portion 32 of the heat transfer tube 30 needs to be led to the vicinity of the first drainage region 11 through the first groove 21 to prevent water from retaining in the vicinity of the central part in the width direction on the top surface 35 of the heat transfer tube 30. Thus, to guide the water dropping into the water introducing region 13 from the vicinity of the end portion 32 of the heat transfer tube 30 to the vicinity of the first drainage region 11 through the first groove 21, the first angle of inclination 21*a* of the first groove 21 needs to be reduced. This is because the bottom end portion of the first groove 21, the top end portion of which is disposed in the vicinity of a lower part of the end portion 32 of the heat transfer tube 30 needs to be disposed in the vicinity of an upper part of the end portion 31 of the heat transfer tube 30 provided below the first groove 21. As a result, the angles of inclination of the convex part 23 and the concave part 24 forming the first groove 21 are reduced, and so it is not possible to sufficiently disturb the air flowing between the fins 10, thus reducing the effect of improving heat transfer performance of the heat exchanger 100.

For example, it is assumed that only the second groove 22 is formed in the water introducing region 13 of the fin 10 and the first groove 21 is not formed in the heat exchanger 100 according to present Embodiment 1. In this case, to improve drainage performance of the heat exchanger 100, it is necessary to guide the water dropping into the water introducing region 13 from the vicinity of the end portion 31 of the heat transfer tube 30 to the vicinity of the second drainage region 12 through the second groove 22 to prevent water from retaining in the vicinity of the central part in the width direction on the top surface 35 of the heat transfer tube 30. In this way, to guide the water dropping into the water introducing region 13 from the vicinity of the end portion 31 of the heat transfer tube 30 to the vicinity of the second drainage region 12 through the second groove 22, it is necessary to reduce the second angle of inclination 22*a* of the second groove 22. This is because the bottom end portion of the second groove 22, a top end portion of which is disposed in the vicinity of the lower part of the end portion 31 of the heat transfer tube 30, needs to be disposed in the vicinity of the upper part of the end portion 32 of the heat transfer tube 30 provided below the second groove 22. As a result, the angles of inclination of the convex part 25 and the concave part 26 forming the second groove 22 are reduced, and so it is not possible to sufficiently disturb the air flowing between the fins 10, thus reducing the effect of improving heat transfer performance of the heat exchanger 100.

On the other hand, in the heat exchanger 100 according to present Embodiment 1, the water dropping into the water introducing region 13 from the vicinity of the end portion 32 of the heat transfer tube 30 can be led to the vicinity of the second drainage region 12 through the second groove 22. Furthermore, the water dropping into the water introducing region 13 from the vicinity of the end portion 31 of the heat transfer tube 30 can be led to the vicinity of the first drainage region 11 through the first groove 21. For this reason, as compared to the case where only one of the first groove 21 and the second groove 22 is formed in the water introducing region 13, the heat exchanger 100 according to present Embodiment 1 can increase the first angle of inclination 21*a* of the first groove 21 and the second angle of inclination 22*a* of the second groove 22. In other words, as compared to the case where only one of the first groove 21 and the second groove 22 is formed in the water introducing region 13, the heat exchanger 100 according to present Embodiment 1 can increase the angles of inclination of the convex part 23 and the concave part 24 forming the first groove 21 and the angles of inclination of the convex part 25 and the concave part 26 forming the second groove 22. Therefore, it is possible to improve heat transfer performance of the heat exchanger 100.

Finally, the first angle of inclination 21*a* of the first groove 21 and the second angle of inclination 22*a* of the second groove 22 suitable for improving heat transfer performance of the heat exchanger 100 will be described.

Figure 6:
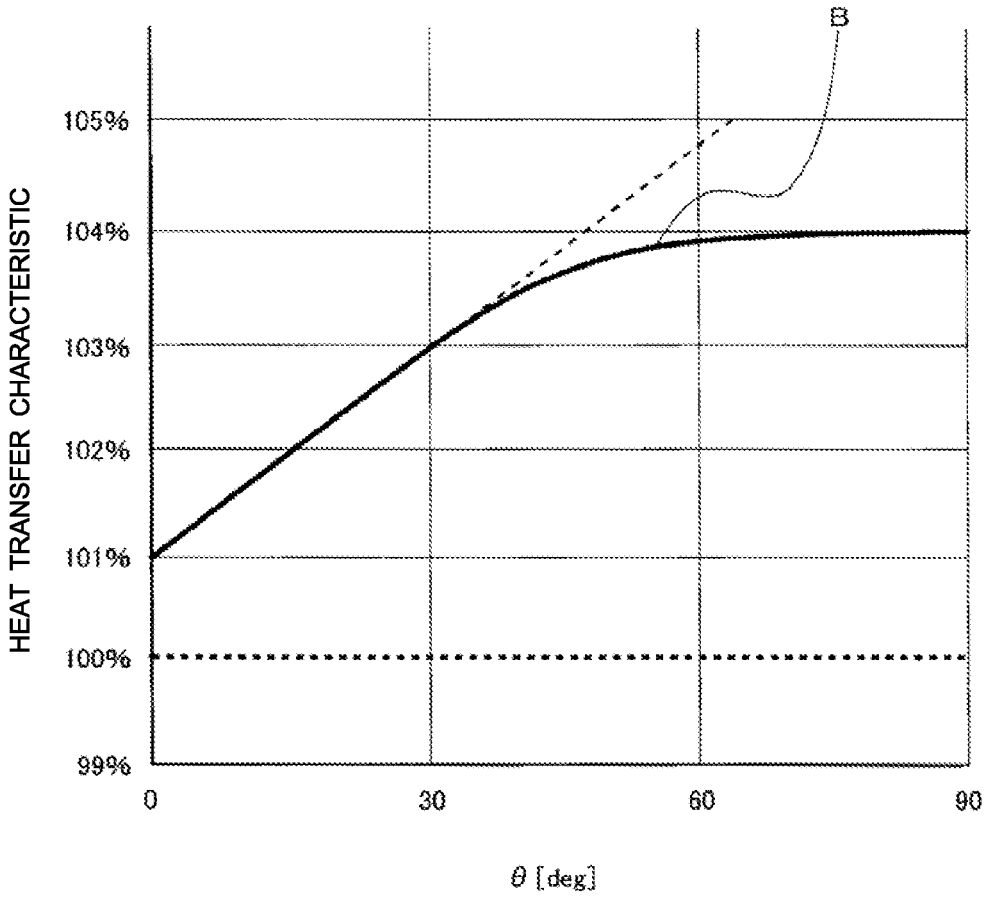
FIG. 6 is a diagram illustrating a relationship between an angle of inclination of a groove part and a heat transfer characteristic of the heat exchanger of Embodiment 1 of the present invention.

FIG. 6 is a diagram illustrating a relationship between an angle of inclination of a groove part and a heat transfer characteristic of the heat exchanger of Embodiment 1 of the present invention.

The figure in FIG. 6 is drawn using the heat exchanger 100 in which only the second groove 22 is formed in the water introducing region 13 of the fin 10 and the first groove 21 is not formed as an experimental sample. Assuming that the second angle of inclination 22*a* of the second groove 22 is θ, the heat transfer characteristic (heat transfer coefficient outside the pipe) of the heat exchanger 100, which is the experimental sample, is measured while changing the value of θ. Note that, in drafting a drawing of FIG. 6, none of the number of second grooves 22 and the height of the convex part 25 forming the second groove 22 is changed. A curve B shown in FIG. 6 represents the measurement result. Note that the heat transfer characteristic shown on the vertical axis in FIG. 6 is presented against the heat transfer characteristic of the heat exchanger 100 where none of the first groove 21 and the second groove 22 is formed in the water introducing region 13 of the fin 10, which is a reference representing 100%.

As shown in FIG. 6, the heat transfer characteristic of the heat exchanger 100 as the experimental sample deteriorates as the second angle of inclination 22*a* of the second groove 22 decreases. Furthermore, when the second angle of inclination 22*a* of the second groove 22 is less than 30 degrees (30 [deg]), the heat transfer characteristic of the heat exchanger 100 as the experimental sample linearly deteriorates. For this reason, to improve heat transfer performance of the heat exchanger 100, the second angle of inclination 22*a* of the second groove 22 is preferably set to 30 degrees or more. In other words, to improve heat transfer performance of the heat exchanger 100, it is preferable to set to 30 degrees or more, the acute angle of angles formed between the line perpendicular to the arrangement direction of the heat transfer tube 30 and the ridge of the convex part 25 forming the second groove 22. In other words, to improve heat transfer performance of the heat exchanger 100, it is preferable to set to 30 degrees or more, the acute angle of angles formed between the line perpendicular to the arrangement direction of the heat transfer tube 30 and the base portion of the concave part 26 forming the second groove 22.

Note that the relationship between the first angle of inclination 21*a* of the first groove 21 and the heat transfer characteristic of the heat exchanger 100 is also similar to that shown in FIG. 6. That is, to improve heat transfer performance of the heat exchanger 100, it is preferable to set at least one of the first angle of inclination 21*a* of the first groove 21 and the second angle of inclination 22*a* of the second groove 22 to 30 degrees or more.

As described above, the heat exchanger 100 according to present Embodiment 1 includes: the fin 10 having the first through hole (through hole 15) and the second through hole (through hole 15) disposed below the first through hole and including the first end portion 10*a* and the second end portion 10*b* in the horizontal direction; the first heat transfer tube (heat transfer tube 30) inserted into the first through hole, a cross-section of the first heat transfer tube parallel to the fin 10 having a flat shape; and the second heat transfer tube (heat transfer tube 30) inserted into the second through hole, a cross-section of the second heat transfer tube parallel to the fin 10 having a flat shape. Furthermore, in the heat exchanger 100 according to present Embodiment 1, when a virtual straight line passing through the end portion 31 of the first heat transfer tube on the first end portion 10*a* side and the end portion 31 of the second heat transfer tube on the first end portion 10*a* is referred to as the first virtual straight line 41, a virtual straight line passing through the end portion 32 of the first heat transfer tube on the second end portion 10*b* side and the end portion 32 of the second heat transfer tube on the second end portion 10*b* side is referred to as the second virtual straight line 42, a region on the surface of the fin 10 between the first end portion 10*a* and the first virtual straight line 41 is referred to as the first drainage region 11, a region on the surface of the fin 10 between the second end portion 10*b* and the second virtual straight line 42 is referred to as the second drainage region 12, and a region on the surface of the fin 10 enclosed by the first heat transfer tube, the second heat transfer tube, the first virtual straight line 41 and the second virtual straight line 42 is referred to as the water introducing region 13, the water introducing region 13 is provided with the first groove 21 inclined to descend toward the first drainage region 11 and the second groove 22 inclined to descend toward the second drainage region 12 disposed closer to the second drainage region 12 than the first groove 21.

In the heat exchanger 100 according to present Embodiment 1, no notch for attaching the heat transfer tube to the fin is formed in the first drainage region 11 and the second drainage region 12. For this reason, water adhering to the first drainage region 11 and the second drainage region 12 is rapidly discharged from the bottom end of the fin 10 to the outside of the heat exchanger 100. The heat exchanger 100 according to present Embodiment 1 can guide the water in the water introducing region 13 to the first drainage region 11 or the second drainage region through the first groove 21 and the second groove 22 to suppress water retaining in the vicinity of the central part in the width direction on the top surface 35 of the heat transfer tube 30. Therefore, the heat exchanger 100 according to present Embodiment 1 can improve drainage performance.

Compared to the case where only one of the first groove 21 and the second groove 22 is formed in the water introducing region 13, the heat exchanger 100 according to present Embodiment 1 can increase the first angle of inclination 21*a* of the first groove 21 and the second angle of inclination 22*a* of the second groove 22. In other words, compared to the case where only one of the first groove 21 and the second groove 22 is formed in the water introducing region 13, the heat exchanger 100 according to present Embodiment 1 can increase the angles of inclination of the convex part 23 and the concave part 24 forming the first groove 21 and the angles of inclination of the convex part 25 and the concave part 26 forming the second groove 22. Therefore, the heat transfer performance of the heat exchanger 100 can be improved.

Note that the configurations of the first groove 21 and the second groove 22 shown in present Embodiment 1 are merely examples. The first groove 21 and the second groove 22 may also be configured, for example, as shown below.

Figure 7:
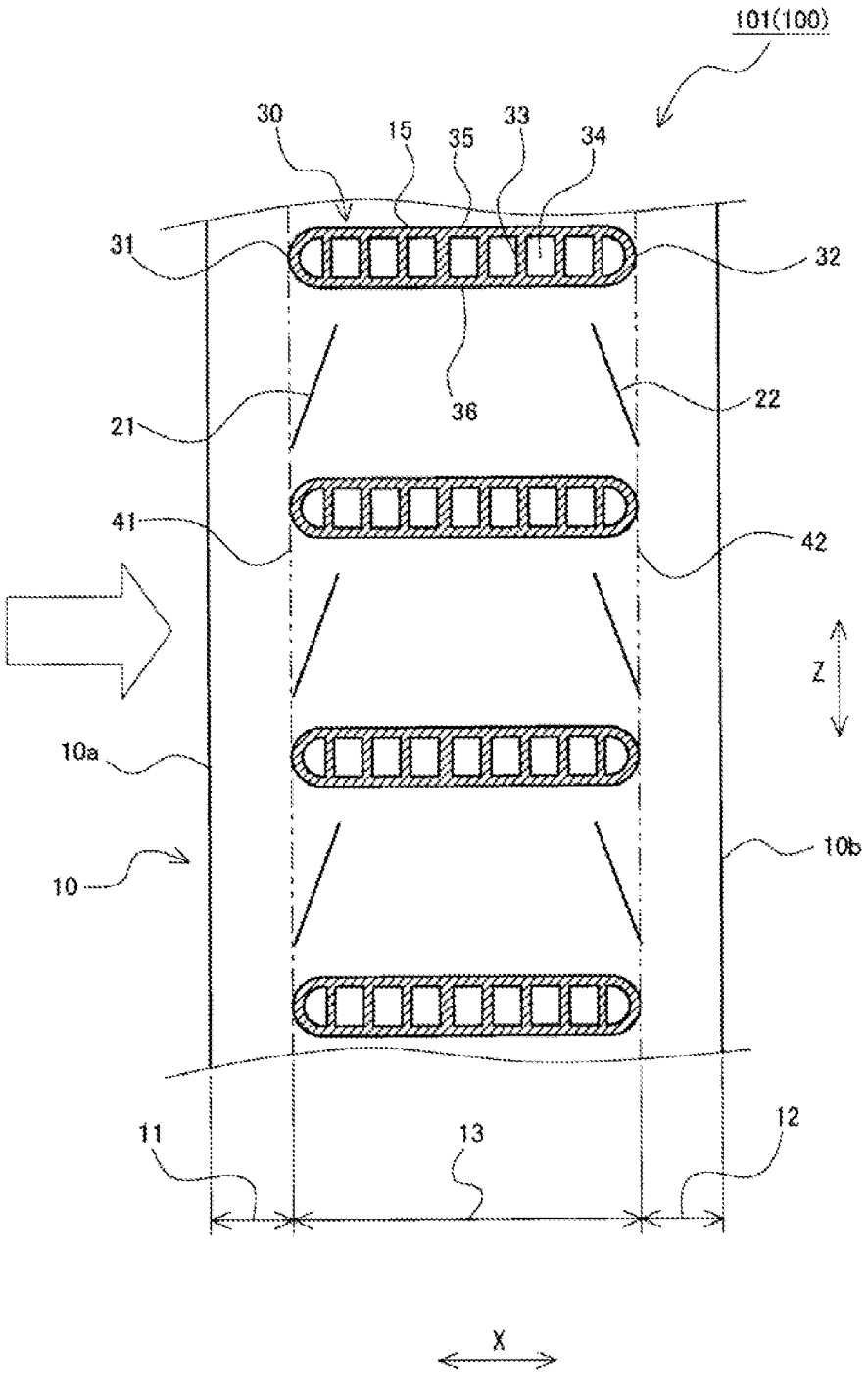
FIG. 7 is a longitudinal cross-sectional view illustrating essential parts of another example of the heat exchanger of Embodiment 1 of the present invention.

FIG. 7 is a longitudinal cross-sectional view illustrating essential parts of another example of the heat exchanger according to Embodiment 1 of the present invention. FIG. 7 shows another example of the heat exchanger 100 viewed from the same observation position as that in FIG. 2.

The configuration has been described in present Embodiment 1 in which the plurality of first grooves 21 and the plurality of second grooves 22 are formed in one water introducing region 13. However, as shown in FIG. 7, at least one first groove 21 and at least one second groove 22 may be formed in one water introducing region 13. Even when the first groove 21 and the second groove 22 are configured in this way, it is also possible to improve the drainage performance of the heat exchanger 100 and improve the heat transfer performance of the heat exchanger 100.

Furthermore, in present Embodiment 1, a configuration is described in which the first groove 21 and the second groove 22 are formed on both surfaces of the surface 10*c* and the surface 10*d* of the fin 10. However, the first groove 21 and the second groove 22 may be formed on at least one of the surface 10*c* and the surface 10*d*. Even when the first groove 21 and the second groove 22 are configured in this way, it is possible to improve the drainage performance of the heat exchanger 100 and improve the heat transfer performance of the heat exchanger 100.

Figure 8:
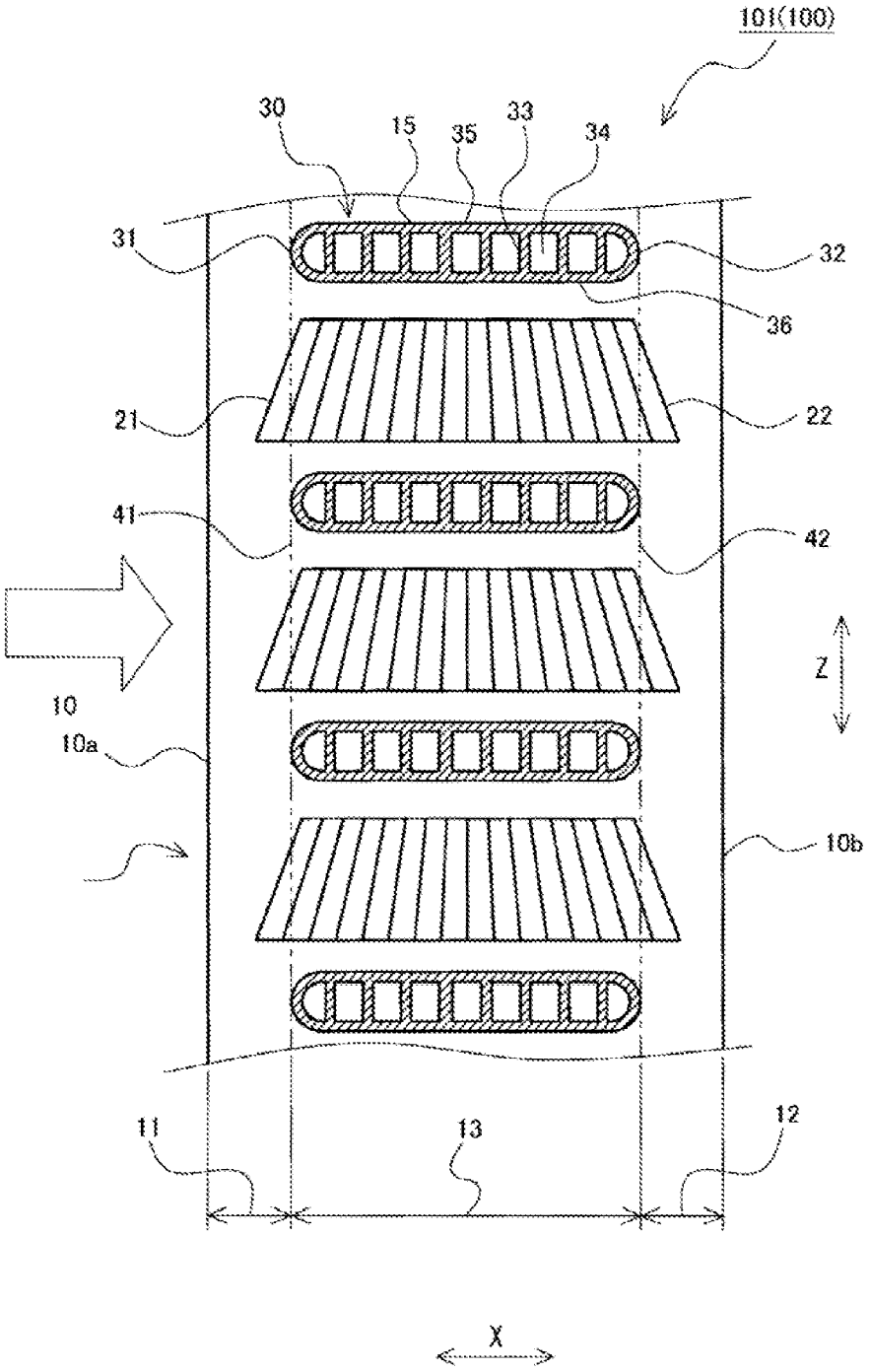
FIG. 8 is a longitudinal cross-sectional view illustrating essential parts of a still another example of the heat exchanger of Embodiment 1 of the present invention.

FIG. 8 is a longitudinal cross-sectional view illustrating essential parts of a still another example of the heat exchanger according to Embodiment 1 of the present invention. FIG. 8 shows a still another example of the heat exchanger 100 as viewed from the same observation position as that in FIG. 2.

In present Embodiment 1, the configuration is described in which the plurality grooves: the first groove 21 and the second groove 22, are formed separately from each other. However, as shown in FIG. 8, the first groove 21 and the second groove 22 may be formed continuously by forming the convex parts 23 and the convex parts 25 continuously. Even when the first groove 21 and the second groove 22 are configured in this way, it is also possible to improve the drainage performance of the heat exchanger 100 and improve the heat transfer performance of the heat exchanger 100.

Furthermore, in present Embodiment 1, the configuration is described in which air is supplied from the first end portion 10*a* side of the fin 10 to the heat exchanger 100. Without being limited to this, even when air is supplied to the heat exchanger 100 from the second end portion 10*b* side of the fin 10, it is also possible to improve the drainage performance of the heat exchanger 100 and improve the heat transfer performance of the heat exchanger 100 as in the case where air is supplied to the heat exchanger 100 from the first end portion 10*a* side of the fin 10.

Embodiment 2

In Embodiment 1, the first angle of inclination 21*a* of the first groove 21 and the second angle of inclination 22*a* of the second groove 22 are substantially the same. Without being limited thereto, the first angle of inclination 21*a* of the first groove 21 and the second angle of inclination 22*a* of the second groove 22 may be different from each other. Note that it is assumed in present Embodiment 2 that items not particularly described are similar to those in Embodiment 1, and identical functions and components will be described using identical reference numerals.

Figure 9:
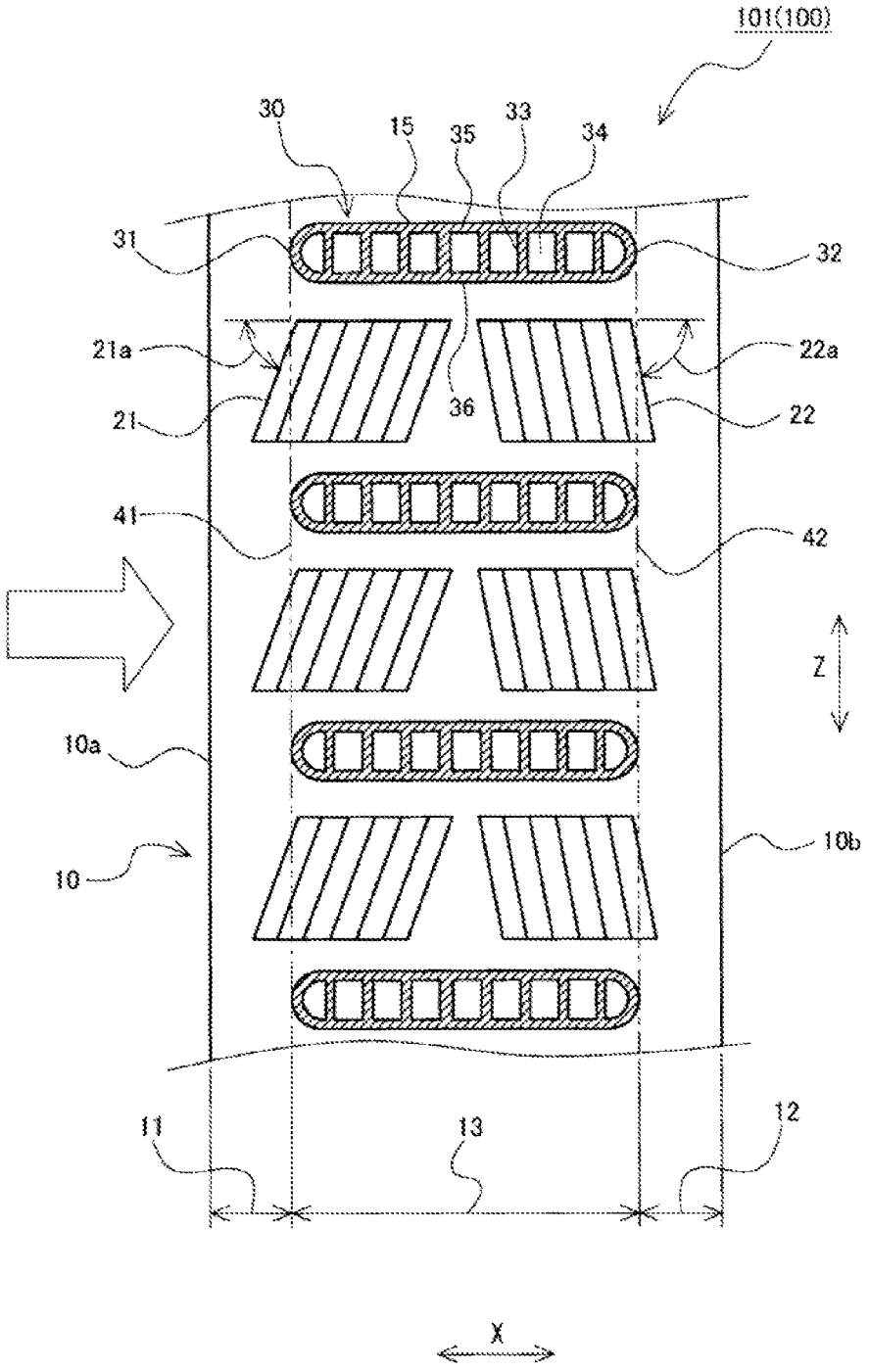
FIG. 9 is a longitudinal cross-sectional view illustrating essential parts of a heat exchanger of Embodiment 2 of the present invention.

FIG. 9 is a longitudinal cross-sectional view illustrating essential parts of a heat exchanger according to Embodiment 2 of the present invention. FIG. 9 illustrates essential parts of the heat exchanger 100 according to present Embodiment 2 viewed from the same observation position as that in FIG. 2.

The heat exchanger 100 according to present Embodiment 2 is supplied with air by a fan from the first end portion 10*a* side of the fin 10 as shown by a white arrow in FIG. 9. Therefore, water adhering to the surfaces of the fin 10 and the heat transfer tube 30 is led by the air supplied from the fan to the downwind-side in the air flow direction. That is, while air is being supplied from the fan to the heat exchanger 100, water adhering to the surfaces of the fin 10 and the heat transfer tube 30 is easily discharged from the second drainage region 12.

That is, when the first angle of inclination 21*a* of the first groove 21 and the second angle of inclination 22*a* of the second groove 22 are substantially the same, while air is being supplied from the fan to the heat exchanger 100, the performance of drainage to the second drainage region 12 by the second groove 22 is higher than the performance of drainage to the first drainage region 11 by the first groove 21. Therefore, the heat exchanger 100 according to present Embodiment 2 makes the second angle of inclination 22*a* of the second groove 22 larger than the first angle of inclination 21*a* of the first groove 21. Such a configuration can also make the performance of drainage to the second drainage region 12 by the second groove 22 comparable to the performance of drainage to the first drainage region 11 by the first groove 21.

As described above, even when the heat exchanger 100 is configured as in present Embodiment 2, it is possible to improve the drainage performance of the heat exchanger 100. Since the second angle of inclination 22*a* of the second groove 22 is made larger, the heat exchanger 100 according to present Embodiment 2 can further improve the heat transfer performance of the heat exchanger 100.

Note that Embodiment 1 shows that it is preferable to set at least one of the first angle of inclination 21*a* of the first groove 21 and the second angle of inclination 22*a* of the second groove 22 to 30 degrees or more to improve the heat transfer performance of the heat exchanger 100. In the heat exchanger 100 according to present Embodiment 2 in which the second angle of inclination 22*a* is larger than the first angle of inclination 21*a*, of the first angle of inclination 21*a* and the second angle of inclination 22*a*, at least the second angle of inclination 22*a* is preferably set to 30 degrees or more.

Embodiment 3

In Embodiment 1 and Embodiment 2, the heat transfer tube 30 is installed such that the major axis of the heat transfer tube 30 in cross-section is oriented in the horizontal direction (X-direction). However, an installation state of the heat transfer tube 30 is not limited to the installation state shown in Embodiment 1 and Embodiment 2. For example, the installation state of the heat transfer tube 30 of the heat exchanger 100 shown in Embodiment 1 and Embodiment 2 may be one as shown in present Embodiment 3. Note that it is assumed in present Embodiment 3 that items not particularly described are similar to those in Embodiment 1 or Embodiment 2, and identical functions and components will be described using identical reference numerals.

Figure 10:
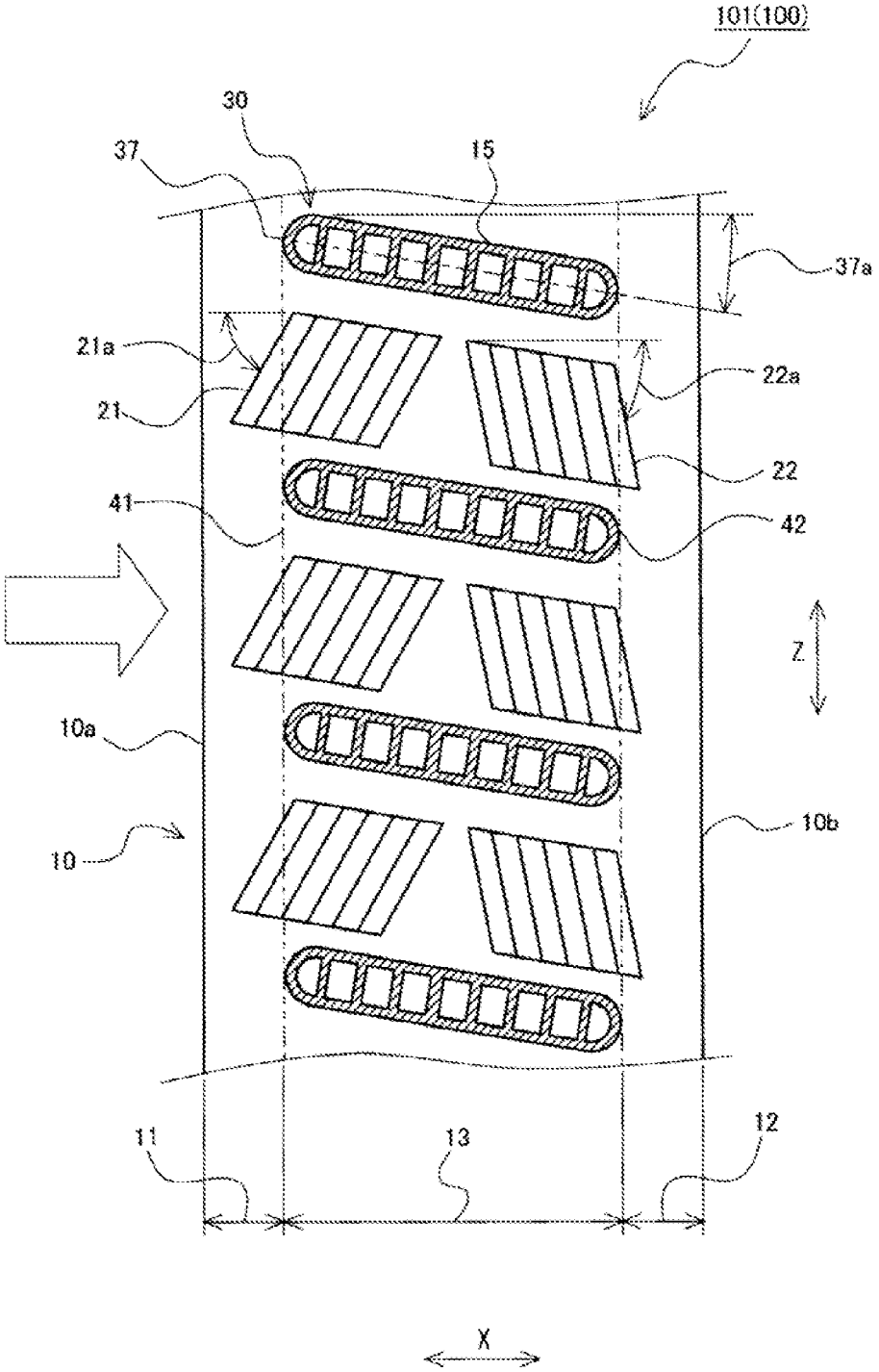
FIG. 10 is a longitudinal cross-sectional view illustrating essential parts of a heat exchanger of Embodiment 3 of the present invention.

FIG. 10 is a longitudinal cross-sectional view illustrating essential parts of a heat exchanger according to Embodiment 3 of the present invention. FIG. 10 illustrates essential parts of the heat exchanger 100 according to present Embodiment 3 as viewed from the same observation position as that in FIG. 2. In other words, FIG. 10 is a longitudinal cross-sectional view cut along cross-section parallel to the fin 10.

The heat transfer tube 30 of the heat exchanger 100 according to present Embodiment 3 is inserted into the through hole 15 of the fin 10 such that a major axis 37 of the heat transfer tube 30 in cross-section parallel to the fin 10 is inclined from the first drainage region 11 toward the second drainage region 12. In present Embodiment 3, the major axis 37 of the heat transfer tube 30 in cross-section is inclined by a third angle of inclination 37*a* relative to the X-direction, which is a flow direction of air supplied from the fan. That is, the major axis 37 of the heat transfer tube 30 in cross-section is inclined by the third angle of inclination 37*a* relative to a line perpendicular to the arrangement direction of the heat transfer tube 30. Note that the third angle of inclination 37*a* is an acute angle of angles formed between the line perpendicular to the arrangement direction of the heat transfer tube 30 and the major axis 37 in cross-section parallel to the fin 10.

With the heat transfer tube 30 installed in the fin 10, water adhering to the surface of the heat transfer tube 30 slides down toward the second drainage region 12 by gravity. For this reason, it is possible to improve drainage performance of the water adhering to the surface of the heat transfer tube 30.

Note that, of the water sliding down toward the second drainage region 12 from the heat transfer tube 30, water not flowing out to the second drainage region 12 flows into the second groove 22. For this reason, a capability of the second groove 22 of discharging water downward to prevent water from retaining in the second groove 22 is preferably higher than a capability of the heat transfer tube 30 of discharging water downward. Therefore, the second angle of inclination 22*a* of the second groove 22 is preferably larger than the third angle of inclination 37*a* of the heat transfer tube 30.

When the heat transfer tube 30 is installed as shown in present Embodiment 3, air is preferably supplied from the first end portion 10*a* of the fin 10 by the fan as indicated by a white arrow in FIG. 10. Water adhering to the surface of the heat transfer tube 30 is led to the second drainage region 12 by air supplied from the fan in addition to gravity. Therefore, it is possible to improve the drainage performance of the water adhering to the surface of the heat transfer tube 30.

The installation state of the heat transfer tube 30 of the heat exchanger 100 shown in Embodiment 1 and Embodiment 2 may be one as shown in present Embodiment 3, and it is thereby possible to further improve the drainage performance of the heat exchanger 100 shown in Embodiment 1 and Embodiment 2.

Embodiment 4

In present Embodiment 4, an example of a refrigeration cycle device according to the present invention will be described. In other words, an example of a refrigeration cycle device provided with the heat exchanger according to the present invention will be described in present Embodiment 4. More specifically, an example where the refrigeration cycle device according to the present invention is used as an air-conditioning device will be described in present Embodiment 4 as an example of the refrigeration cycle device according to the present invention. Note that it is assumed in present Embodiment 4 that items that are not particularly described are similar to those in Embodiment 1 to Embodiment 3, and identical functions and components will be described using identical reference numerals.

Figure 11:
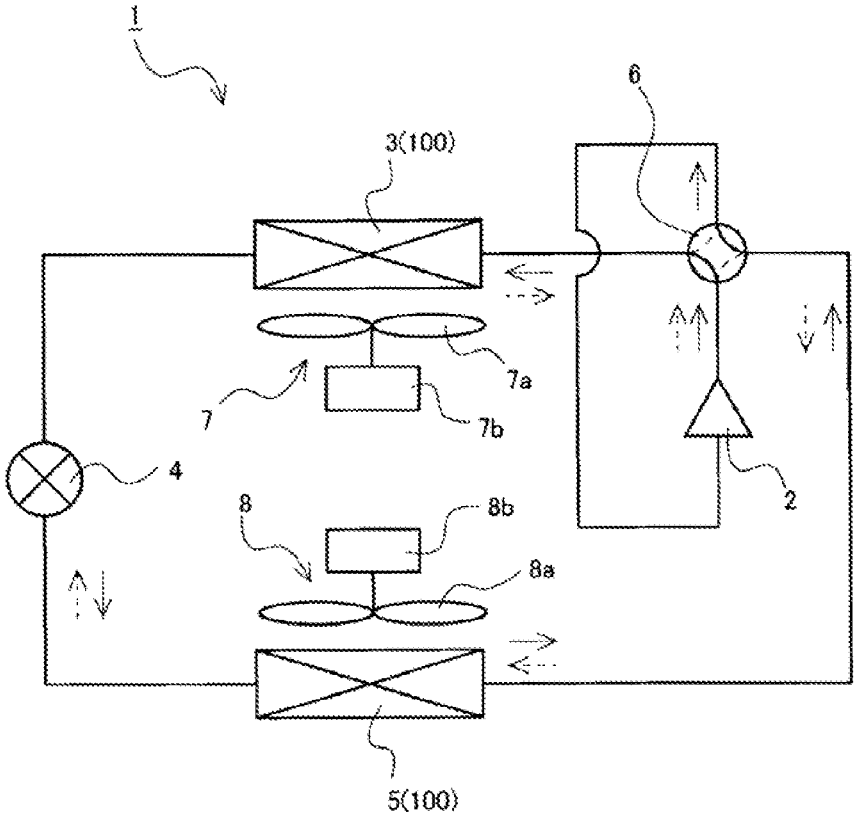
FIG. 11 is a circuit configuration diagram schematically illustrating an example of a refrigerant circuit configuration of a refrigeration cycle device of Embodiment 4 of the present invention.

FIG. 11 is a circuit configuration diagram schematically illustrating an example of a refrigerant circuit configuration of the refrigeration cycle device according to Embodiment 4 of the present invention. A refrigeration cycle device 1 will be described with reference to FIG. 11. Note that in FIG. 11, a flow of refrigerant during cooling operation is indicated by a broken line arrow and a flow of refrigerant during heating operation is indicated by a solid line arrow.

As shown in FIG. 11, the refrigeration cycle device 1 is provided with a compressor 2, a channel switchover device 6, a first heat exchanger 3, an expansion device 4, a second heat exchanger 5, an indoor fan 7 and an outdoor fan 8. The compressor 2, the first heat exchanger 3, the expansion device 4 and the second heat exchanger 5 are connected via a refrigerant pipe to form a refrigerant circuit. The indoor fan 7 is installed in the vicinity of the first heat exchanger 3 to supply indoor air (air in a space to be air-conditioned) to the first heat exchanger 3. The indoor fan 7 is provided with an impeller 7*a* and a motor 7*b* that rotates the impeller 7*a*. The outdoor fan 8 is installed in the vicinity of the second heat exchanger 5 to supply outdoor air to the second heat exchanger 5. The outdoor fan 8 is provided with an impeller 8*a* and a motor 8*b* that rotates the impeller 8*a*.

The compressor 2 compresses refrigerant. The refrigerant compressed by the compressor 2 is discharged and sent to the first heat exchanger 3. The compressor 2 can be, for example, a rotary compressor, a scroll compressor, a screw compressor, or a reciprocating compressor.

The first heat exchanger 3, which is an indoor heat exchanger, functions as a condenser during heating operation or functions as an evaporator during cooling operation. That is, when the first heat exchanger 3 functions as a condenser, it exchanges heat between a high-temperature, high-pressure refrigerant discharged from the compressor 2 and indoor air supplied from the indoor fan 7, and a high-temperature, high-pressure gaseous refrigerant is thereby condensed. On the other hand, when the first heat exchanger 3 functions as an evaporator, it exchanges heat between a low-temperature, low-pressure refrigerant flowing out from the expansion device 4 and indoor air supplied from the indoor fan 7, and a low-temperature, low-pressure liquid refrigerant or two-phase refrigerant is thereby evaporated.

The expansion device 4 expands and decompresses the refrigerant flowing out from the first heat exchanger 3 or the second heat exchanger 5. The expansion device 4 may also be, for example, an electric expansion valve that can adjust a flow rate of the refrigerant. Note that a mechanical expansion valve that adopts a diaphragm for a pressure-receiving unit or capillary tube may be applicable as the expansion device 4 in addition to the electric expansion valve.

The second heat exchanger 5, which is an outdoor heat exchanger, functions as an evaporator during heating operation or functions as a condenser during cooling operation. That is, when the second heat exchanger 5 functions as an evaporator, it exchanges heat between a low-temperature, low-pressure refrigerant flowing out from the expansion device 4 and outdoor air supplied from the outdoor fan 8, and a low-temperature, low-pressure liquid refrigerant or two-phase refrigerant is thereby evaporated. On the other hand, when the second heat exchanger 5 functions as a condenser, it exchanges heat between a high-temperature, high-pressure refrigerant discharged from the compressor 2 and the outdoor air supplied from the outdoor fan 8, and a high-temperature, high-pressure gaseous refrigerant is thereby condensed.

The channel switchover device 6 switches the refrigerant flow between heating operation and cooling operation. That is, the channel switchover device 6 can perform switching so that the compressor 2 is connected to the first heat exchanger 3 during heating operation or the compressor 2 is connected to the second heat exchanger 5 during cooling operation. Note that the channel switchover device 6 may be constructed of, for example, a four-way valve. However, a combination of two-way valves or three-way valves may also be adopted as the channel switchover device 6. Furthermore, when the refrigeration cycle device 1 performs only one of cooling operation and heating operation, the channel switchover device 6 is not necessary.

Here, as described above, in the refrigeration cycle device 1, the second heat exchanger 5 functions as an evaporator during heating operation. On the other hand, the first heat exchanger 3 functions as an evaporator during cooling operation. Thus, present Embodiment 4 uses the heat exchanger 100 according to any one of Embodiment 1 to Embodiment 3 having excellent drainage performance and excellent heat transfer performance as the second heat exchanger 5 and the first heat exchanger 3. That is, the refrigeration cycle device 1 uses the heat exchanger 100 according to any one of Embodiment 1 to Embodiment 3 as the heat exchanger functioning as an evaporator. Note that the heat exchanger 100 according to any one of Embodiment 1 to Embodiment 3 may be used for only one of the first heat exchanger 3 and the second heat exchanger 5.

Next, operation of the refrigeration cycle device 1 will be described together with a refrigerant flow.

First, cooling operation executed by the refrigeration cycle device 1 will be described. Note that a refrigerant flow during cooling operation is indicated by a broken line arrow in FIG. 11.

As shown in FIG. 11, by driving the compressor 2, high-temperature, high-pressure refrigerant in a gaseous state is discharged from the compressor 2. Hereinafter, the refrigerant will flow in a direction indicated by the broken line arrow. The high-temperature, high-pressure gaseous refrigerant (single-phase) discharged from the compressor 2 flows into the second heat exchanger 5 that functions as a condenser via the channel switchover device 6. The second heat exchanger 5 exchanges heat between the high-temperature, high-pressure gaseous refrigerant flowing thereinto and outdoor air supplied by the outdoor fan 8, and the high-temperature, high-pressure gaseous refrigerant is thereby condensed to be a high-pressure liquid refrigerant (single-phase).

The high-pressure liquid refrigerant sent out from the second heat exchanger 5 is converted by the expansion device 4 into refrigerant in a two-phase state of low-pressure gaseous refrigerant and liquid refrigerant. The two-phase state refrigerant flows into the first heat exchanger 3 that functions as an evaporator. The first heat exchanger 3 exchanges heat between the two-phase state refrigerant flowing thereinto and the indoor air supplied from the indoor fan 7 and the liquid refrigerant of the two-phase state refrigerant is evaporated and converted into low-pressure gaseous refrigerant (single-phase). The low-pressure gaseous refrigerant sent out from the first heat exchanger 3 flows into the compressor 2 via the channel switchover device 6, is compressed, is further converted into a high-temperature, high-pressure gaseous refrigerant and is discharged from the compressor 2 again. This cycle is repeated hereinafter.

Here, in the first heat exchanger 3 that functions as the evaporator, the indoor air supplied from the indoor fan 7 is cooled by the first heat exchanger 3 and moisture in the indoor air condenses on the first heat exchanger 3. For this reason, when the first heat exchanger 3 has poor drainage performance, heat exchange between the indoor air and the first heat exchanger 3 is impaired by a water film and heat transfer performance of the first heat exchanger 3 deteriorates. Furthermore, when the first heat exchanger 3 has poor drainage performance, ventilation resistance of the indoor air passing through the first heat exchanger 3 increases due to the water adhering to the first heat exchanger 3. For this reason, the cooling performance of the refrigeration cycle device 1 deteriorates.

However, the refrigeration cycle device 1 according to present Embodiment 4 uses the heat exchanger 100 according to any one of Embodiment 1 to Embodiment 3 as the first heat exchanger 3. Therefore, the first heat exchanger 3 according to present Embodiment 4 has excellent drainage performance and can thereby prevent heat exchange between the indoor air and the first heat exchanger 3 from being impaired by the water film. Moreover, the first heat exchanger 3 according to present Embodiment 4 can also prevent ventilation resistance of the indoor air passing through the first heat exchanger 3 due to water adhering to the first heat exchanger 3 from increasing. The heat transfer performance of the heat exchanger 100 according to any one of Embodiment 1 to Embodiment 3 is also improved by the first groove 21 and the second groove 22 as described above. Therefore, the cooling performance of the refrigeration cycle device 1 according to present Embodiment 4 is improved.

Next, heating operation executed by the refrigeration cycle device 1 will be described. Note that the refrigerant flow during heating operation is indicated by a solid line arrow in FIG. 11.

As shown in FIG. 11, a high-temperature, high-pressure refrigerant in a gaseous state is discharged from the compressor 2 by driving the compressor 2. Hereinafter, the refrigerant flows according to the solid line arrow. The high-temperature, high-pressure gaseous refrigerant (single-phase) discharged from the compressor 2 flows into the first heat exchanger 3 that functions as a condenser via the channel switchover device 6. The first heat exchanger 3 exchanges heat between the high-temperature, high-pressure gaseous refrigerant flowing thereinto and the indoor air supplied by the indoor fan 7 and the high-temperature, high-pressure gaseous refrigerant condenses and is converted into high-pressure liquid refrigerant (single-phase).

The high-pressure liquid refrigerant sent out from the first heat exchanger 3 is converted into refrigerant in a two-phase state of low-pressure gaseous refrigerant and liquid refrigerant by the expansion device 4. The two-phase state refrigerant flows into the second heat exchanger 5 that functions as an evaporator. The second heat exchanger 5 exchanges heat between the two-phase state refrigerant flowing thereinto and the outdoor air supplied by the outdoor fan 8, and the liquid refrigerant of the two-phase state refrigerant is thereby evaporated into low-pressure gaseous refrigerant (single-phase). The low-pressure gaseous refrigerant sent out from the second heat exchanger 5 flows into the compressor 2 via the channel switchover device 6, is compressed, converted into high-temperature, high-pressure gaseous refrigerant and discharged from the compressor 2 again. This cycle is repeated hereinafter.

Here, in the second heat exchanger 5 that functions as an evaporator, the outdoor air supplied from the outdoor fan 8 is cooled by the second heat exchanger 5 and moisture in the outdoor air condenses on the second heat exchanger 5. For this reason, when the second heat exchanger 5 has poor drainage performance, heat exchange between the outdoor air and the second heat exchanger 5 is impaired by a water film, causing the heat transfer performance of the second heat exchanger 5 to deteriorate. When the second heat exchanger 5 has poor drainage performance, ventilation resistance of the outdoor air passing through the second heat exchanger 5 is increased by water adhering to the second heat exchanger 5. Thus, the heating performance of the refrigeration cycle device 1 deteriorates.

However, the refrigeration cycle device 1 according to present Embodiment 4 uses the heat exchanger 100 according to any one of Embodiment 1 to Embodiment 3 as the second heat exchanger 5. Thus, the second heat exchanger 5 according to present Embodiment 4 has excellent drainage performance and can thereby prevent heat exchange between the outdoor air and the second heat exchanger 5 from being impaired by the water film. Furthermore, the first heat exchanger 3 according to present Embodiment 4 can also prevent ventilation resistance of the outdoor air passing through the second heat exchanger 5 from increasing due to water adhering to the second heat exchanger 5. The heat transfer performance of the heat exchanger 100 according to any one of Embodiment 1 to Embodiment 3 is also improved by the first groove 21 and the second groove 22. Therefore, the heating performance of the refrigeration cycle device 1 according to present Embodiment 4 is improved.

When the refrigeration cycle device 1 performs heating operation in a low outside air temperature environment, the second heat exchanger 5 exchanges heat with low-temperature outdoor air, and so the water adhering to the second heat exchanger may freeze into frost. Therefore, when the refrigeration cycle device 1 according to present Embodiment 4 performs heating operation under a condition in which frost is formed on the second heat exchanger 5, "defrosting operation" is performed to remove frost attached to the second heat exchanger 5 in the middle of the heating operation. For example, the refrigeration cycle device 1 performs the defrosting operation when the outdoor air temperature falls to or below a predetermined temperature (e.g., 0 degrees C.).

The "defrosting operation" refers to an operation of supplying hot gas (high-temperature, high-pressure gaseous refrigerant) from the compressor 2 to the second heat exchanger 5 to prevent frost from adhering to the second heat exchanger 5 that functions as an evaporator or to melt frost adhering to the second heat exchanger 5. Note that the defrosting operation may be executed when the duration of heating operation reaches a predetermined value (e.g., 30 minutes). Furthermore, the defrosting operation may be executed before the heating operation is performed, when the second heat exchanger 5 falls to or below a predetermined temperature (e.g., minus 6 degrees C.). The frost adhering to the second heat exchanger 5 is melted by the hot gas supplied to the second heat exchanger 5 during the defrosting operation.

Here, the defrosting operation is performed until the frost adhering to the second heat exchanger 5 is melted and water generated by melting of frost is discharged from the second heat exchanger 5. For this reason, when the second heat exchanger 5 has poor drainage performance, the defrosting time increases and comfortability is degraded, leading to a reduction of average heating capacity for a certain period of time due to repeated heating operation and defrosting operation.

However, as described above, the refrigeration cycle device 1 according to present Embodiment 4 uses the heat exchanger 100 described in any one of Embodiment 1 to Embodiment 3 as the second heat exchanger 5. For this reason, the second heat exchanger 5 according to present Embodiment 4 has excellent drainage performance, and can thereby finish the defrosting operation in a short time. Therefore, the refrigeration cycle device 1 according to present Embodiment 4 can prevent degradation of comfortability and also prevent a reduction of the average heating capacity.

Note that the refrigerant used for the refrigeration cycle device 1 is not particularly limited, and effects can also be exerted using refrigerant such as R410A, R32, and HFO1234yf.

Furthermore, air and refrigerant are presented as examples of working fluids, but the present invention is not limited to this, and similar effects can be exerted using other gas, liquid or gas-liquid mixture. That is, the working fluid changes in accordance with use of the refrigeration cycle device 1, and effects can be exerted in any case.

Furthermore, for the refrigeration cycle device 1, any refrigerating machine oil such as mineral oil-based, alkyl benzene oil-based, ester oil-based, ether oil-based and fluorine oil-based oil can be used regardless of whether or not the oil is soluble in the refrigerant and effects as the heat exchanger 100 can be exerted.

Other examples of the refrigeration cycle device 1 include a water heater, freezer and air-conditioning combined hot water supplying device, and all such devices can be easily manufactured, and it is possible to improve heat exchange performance and improve energy efficiency.

As described so far, according to the refrigeration cycle device 1 according to present Embodiment 4, a refrigerant circuit is formed of the compressor 2, the first heat exchanger 3, the expansion device 4 and the second heat exchanger 5, and the heat exchanger 100 according to Embodiment 1 to Embodiment 3 is applied to the heat exchanger that functions as the condenser of the first heat exchanger 3 and the second heat exchanger 5, and both improvement of drainage performance and securing of heat transfer performance will be made compatible.

The invention claimed is:

1. A heat exchanger comprising:

a fin having a first through hole and a second through hole disposed below the first through hole, and including a first end portion and a second end portion in a horizontal direction;

a first heat transfer tube inserted into the first through hole, a cross-section of the first heat transfer tube parallel to the fin having a flat shape such that a cross-section in a major axis direction is larger than that in a minor axis direction; and a second heat transfer tube inserted into the second through hole, a cross-section of the second heat transfer tube parallel to the fin having a flat shape such that a cross-section in the major axis direction is larger than that in the minor axis direction, wherein, when a virtual straight line passing through an end portion in the major axis direction of the first heat transfer tube on a first end portion side and an end portion in the major axis direction of the second heat transfer tube on the first end portion side is a first virtual straight line, a virtual straight line passing through an end portion in the major axis direction of the first heat transfer tube on a second end portion side and an end portion in the major axis direction of the second heat transfer tube on the second end portion side is a second virtual straight line, a region between the first end portion and the first virtual straight line on a surface of the fin is a first drainage region, a region between the second end portion and the second virtual straight line on the surface of the fin is a second drainage region, and a region on the surface of the fin enclosed by the first heat transfer tube, the second heat transfer tube, the first virtual straight line and the second virtual straight line is a water introducing region, a first groove inclined to descend toward the first drainage region and a second groove disposed closer to the second drainage region than the first groove and inclined to descend toward the second drainage region are formed in the water introducing region, wherein, when one of angles formed on the surface of the fin between a line perpendicular to an arrangement direction of the first heat transfer tube and the second heat transfer tube, and the first groove, is a first angle of inclination, the first angle of inclination being an acute angle, and one of angles formed on the surface of the fin between the line perpendicular to the arrangement direction of the first heat transfer tube and the second heat transfer tube, and the second groove, is a second angle of inclination, the second angle of inclination being an acute angle, the heat exchanger is configured to receive air from the first end portion, and the second angle of inclination is larger than the first angle of inclination.

2. The heat exchanger of claim 1, wherein, when one of angles formed on the surface of the fin between a line perpendicular to an arrangement direction of the first heat transfer tube and the second heat transfer tube, and the first groove, is a first angle of inclination, the first angle of inclination being an acute angle, and one of angles formed on the surface of the fin between the line perpendicular to the arrangement direction of the first heat transfer tube and the second heat transfer tube, and the second groove, is a second angle of inclination, the second angle of inclination being an acute angle, at least one of the first angle of inclination and the second angle of inclination is 30 degrees or more.

3. The heat exchanger of claim 1, wherein at least the second angle of inclination of the first angle of inclination and the second angle of inclination is 30 degrees or more.

4. The heat exchanger of claim 1, wherein the first heat transfer tube is inserted into the first through hole such that a major axis of the first heat transfer tube in cross-section parallel to the fin is inclined from the first drainage region toward the second drainage region, and the second heat transfer tube is inserted into the second through hole such that a major axis of the second heat transfer tube in cross-section parallel to the fin is inclined from the first drainage region toward the second drainage region.

5. The heat exchanger of claim 4, wherein, when one of angles formed on the surface of the fin between a line perpendicular to an arrangement direction of the first heat transfer tube and the second heat transfer tube, and the second groove, is a second angle of inclination, the second angle of inclination being an acute angle, and one of angles formed in cross-section parallel to the fin between the line perpendicular to the arrangement direction of the first heat transfer tube and the second heat transfer tube, and the major axis of the first heat transfer tube, is a third angle of inclination, the third angle of inclination being an acute angle, the second angle of inclination is larger than the third angle of inclination.

6. A refrigeration cycle device comprising a refrigerant circuit that connects a compressor, a condenser, an expansion device and an evaporator via a refrigerant pipe, wherein the refrigeration cycle device uses the heat exchanger of claim 1 as the evaporator.

7. The refrigeration cycle device of claim 6, further comprising a fan that supplies air from the first end portion to the heat exchanger.

* * * * *